US005855024A

United States Patent [19]

Smith

[11] Patent Number: 5,855,024

[45] Date of Patent: Jan. 5, 1999

[54] SIPHON FOR TANK TYPE TOILET

[75] Inventor: Wade W. Smith, Branchburg, N.J.

[73] Assignee: Water Management Services Inc., San Diego, Calif.

[21] Appl. No.: 805,689

[22] Filed: Feb. 25, 1997

[51] Int. Cl.[6] ..... E03D 1/14

[52] U.S. Cl. ..... 4/325; 4/376; 4/373

[58] Field of Search ..... 4/335, 376, 373, 4/368, 326

[56] References Cited

U.S. PATENT DOCUMENTS

| | | | |
|---|---|---|---|
| 400,982 | 4/1889 | Wicks | 4/373 |
| 1,349,683 | 8/1920 | McCloud | 4/373 |

FOREIGN PATENT DOCUMENTS

| | | | |
|---|---|---|---|
| 339379 | 12/1930 | United Kingdom | 4/373 |
| 463286 | 3/1937 | United Kingdom | 4/373 |

*Primary Examiner*—David J. Walczak
*Attorney, Agent, or Firm*—Spencer T. Smith

[57] ABSTRACT

A siphon for use with a flush type toilet having a tank with a drain hole at the bottom. The siphon comprises a vertical tubular discharge portion including a vertical tube which is secured within the drain hole in the bottom of the tank. The siphon also includes a bell shaped inlet portion including a connecting portion having a downwardly extending tubular portion for telescopic insertion into the vertical tube. A hole in defined in the bell shaped inlet portion and an elbow is secured within the hole and extends downwardly, terminating at a height selected to define the desired flush height of the toilet.

5 Claims, 2 Drawing Sheets

SIPHON FOR TANK TYPE TOILET

BACKGROUND OF THE INVENTION

The present invention relates to a tank type toilet and more particularly to a siphon for controlling the flushing of the toilet.

One conventional siphon is a one piece structure which has a bell shaped inlet portion on one side, a vertical tubular discharge portion on the other side, and a connecting portion connecting the top of these portions. The horizontal intake opening of the bell shaped inlet portion is located about ¼" above the tank bottom and the bottom outlet of the vertical tubular discharge portion is sealingly connected to the discharge opening of the toilet tank. In the ready condition, water fills the bell shaped inlet portion up to the water line of the tank, which is about ½" below the overflow height.

A plunger extends through the top of the bell shaped inlet portion and is connected to an inlet grid. The inlet grid conforms to the shape of the bell shaped inlet portion so that it can be lifted into the bell shaped inlet portion when the flush handle is operated (a "C" link connects the flush handle to the top of the plunger) . A compression spring is located on the plunger between the top of the bell shaped inlet portion and the inlet grid to keep the grid at the bottom of the bell shaped inlet portion when the siphon is not being used. Secured centrally to the top of the grid around the plunger is a flexible plastic cover the shape of the grid. When the flush handle is operated, the plastic covered grid is elevated pushing water out of the bell shaped inlet portion into the vertical outlet portion to establish the siphon which pulls water from the tank, past the flexible plastic cover, which folds out of the way, until the water level of the tank either reaches the bottom of the bell shaped portion or reaches a hole defined in the side of the bell shaped inlet portion. In another conventional siphon design, the vertical outlet portion is a separate piece. The bell shaped inlet portion and the lower part of the vertical outlet portion are vertically keyed so that when a horizontal pin is removed from aligned holes in outwardly projecting posts defined in adjacent portions of the vertical outlet portion and the connecting portion, the bell shaped inlet portion can be vertically displaced out of the tank for maintenance. The top of the vertical outlet portion is outwardly flared to receive the downwardly extending end of the connecting portion with an "O" ring effecting a seal therebetween. Such conventional siphons are dedicated to a toilet tank having a specific toilet which has a predetermined flush height (the vertical drop from the water line required to define a desired flush volume for a tank is referred to as the flush height).

OBJECT OF THE INVENTION

It is accordingly an object of the present invention to provide an improved siphon which can be used with a variety of toilet tanks having different flush heights and water line heights.

Other objects and advantages of the present invention will become apparent from the following specification and the accompanying drawings which illustrate in accordance with the mandate of the patent statutes a presently preferred embodiment of the present invention.

DETAILED DESCRIPTION OF THE PREFERRED EMBODIMENT

Figure 1:
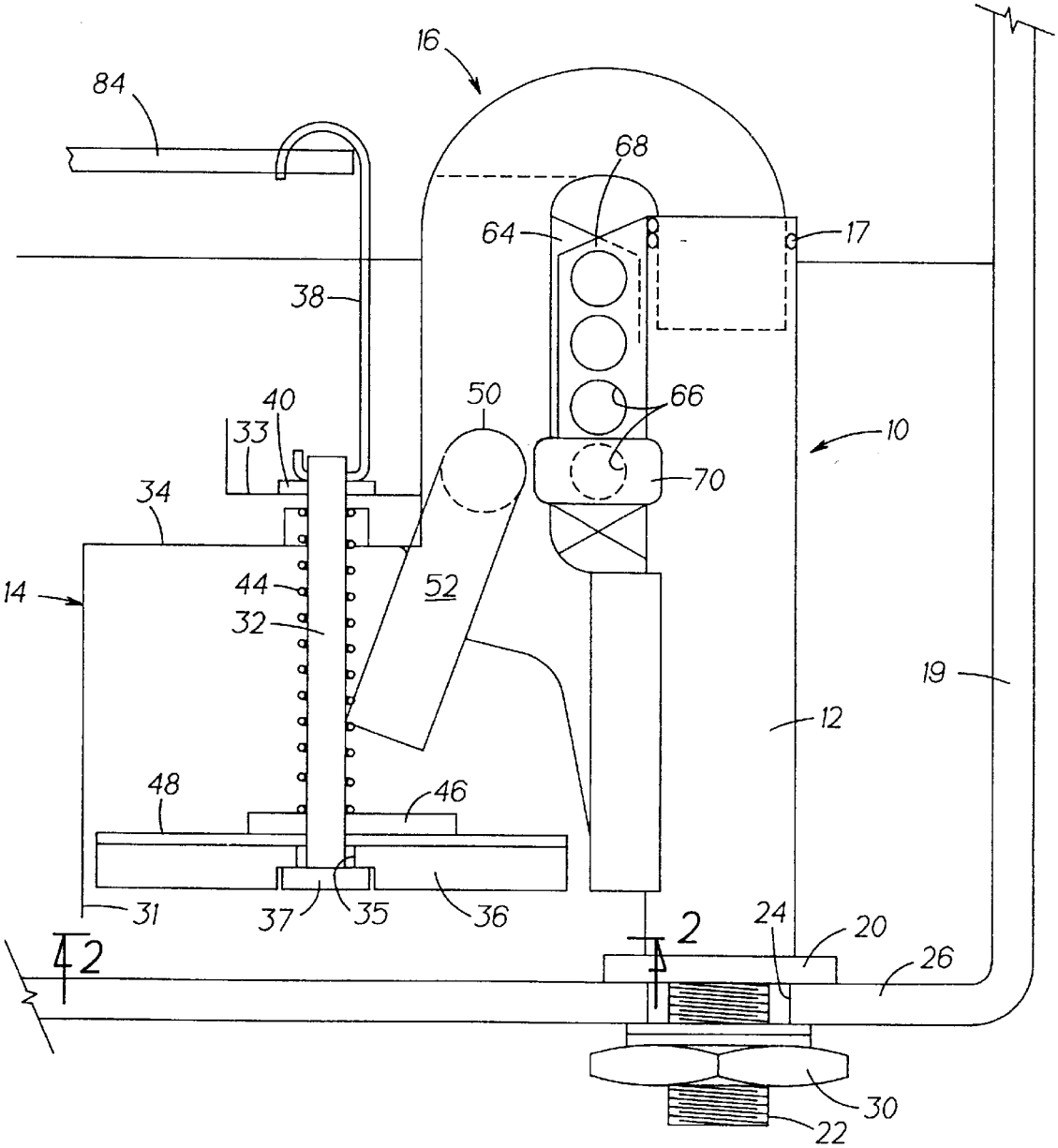
FIG. 1 is an elevational view of a portion of a flush type toilet made in accordance with the teachings of the present invention.

The siphon 10 has a plastic vertical tubular discharge portion 12 which extends upwardly beyond the water level and flares slightly, downwardly and a plastic bell shaped inlet portion 14 and an integral connecting portion 16 which extends upwardly beyond the water line and then downwardly telescopically into the vertical tubular discharge portion (a seal therebetween may be established by an "O" ring 17 and the connecting portion can be key locked, like the inlet leg of a Hunter fill valve). As shown in FIG. 1, the water line is located about ½" below the overflow height. The vertical discharge tubular portion may have a height of from about 7½" to 11½" and will be cut to locate the top above the water line. The bottom outlet of the vertical tubular discharge portion has a flange 20 at the top of a threaded end 22 so that it can be sealingly connected to the discharge opening 24 of the bottom 26 of the china toilet tank 19 by tightening a suitable nut 30. As can be seen from FIG. 1, the entire siphon is supported at the connection of the bottom of the vertical tubular portion 12 and the bottom 26 of the toilet tank. To compensate for a water level that can vary within a vertical range, the siphon is in two pieces with the "U" shaped connecting portion of bell shaped portion 14 being telescopically received by the vertical tubular portion 12. Vertical tubular portion 12 has a top portion of four inches, any portion of which can be cut off, to locate this vertical tubular portion just above the water line as shown in FIG. 1. Assuming that the vertical distance between connecting hole 66 centers is 1¼" and assuming that the vertical tube was 1" taller (1" less was cut off), the bell shaped portion 14 of the siphon would move up 1¼" relative to the vertical portion. The connecting pin 70, would now extend through the second from the bottom connecting hole in the vertical portion connecting bracket 68 and then through the hole in the connecting bracket 64 of the bell shaped portion.

The bell shaped inlet portion 14 has a horizontal intake opening 31 and in the ready condition, water fills the bell shaped inlet portion up to the water line of the tank. A plastic plunger 32 extends through a horizontal platform 33 defined on the top wall 34 of the bell shaped inlet portion and through a suitable hole 35 in a plastic inlet grid 36. The bottom of the plunger ends with a stop 37. The inlet grid matches the shape (internal configuration) of the bell shaped inlet portion so that it can be vertically lifted into the bell shaped inlet portion when the flush handle 84 is operated (a "C" link 38 connects the top of the plunger to the flush handle assembly). A plastic washer 40 is located about the plunger at its top below the "C" link and a compression spring 44 is located around the plunger between the horizontal platform 33 of the bell shaped inlet portion and the inlet grid to keep the grid at the bottom of the bell shaped inlet portion when the siphon is not being used. Secured centrally to the top of the grid around the plunger between a clamping plate 46, which has holes which forcefully receive suitable projections on the top of the grid and the grid, is a flexible plastic cover 48 made from sheet plastic and having the shape of the grid. When the flush handle is operated, the plastic covered grid is elevated pushing water out of the bell shaped inlet portion and into the vertical outlet portion to establish the siphon which pulls water from the tank, past the plastic cover, which folds out of the way, until siphon is broken.

A hole 50 is molded into the side wall of the connecting portion 16, approximately 2½" below the water line and a plastic elbow 52 having an outwardly projecting circumferential lip 54 is inserted into this hole with the elbow facing downward. The elbow has a length which can be cut to locate the elbow opening at a height selected to define a desired flush volume in the specific toilet tank 19 in which it is located (or the one of a plurality of elbows having different heights which correlate to specific toilets, can be installed to define the desired flush height for a specific tank).

Figure 2:
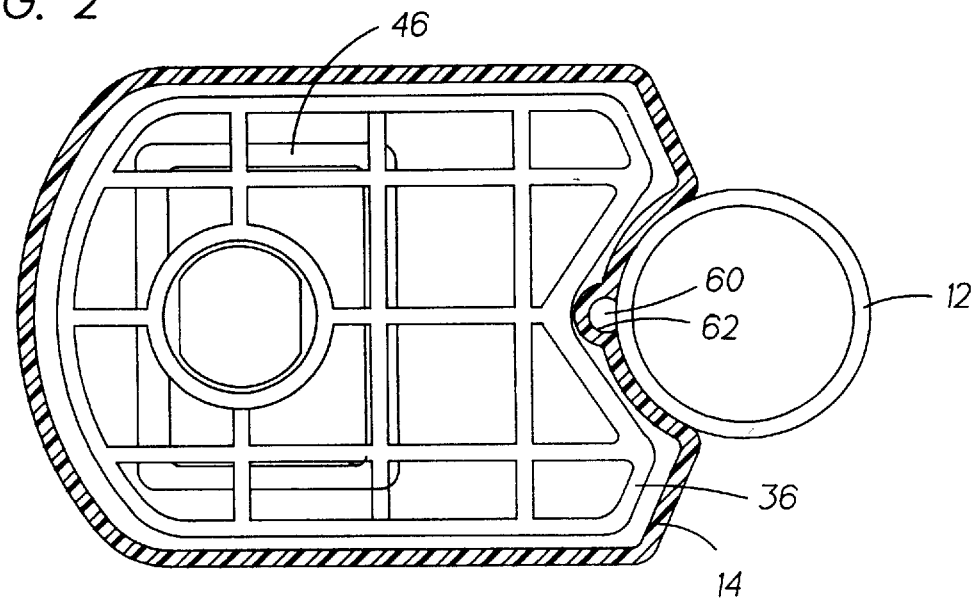
FIG. 2 is a view taken at 2—2 of FIG. 1.
Figure 3:
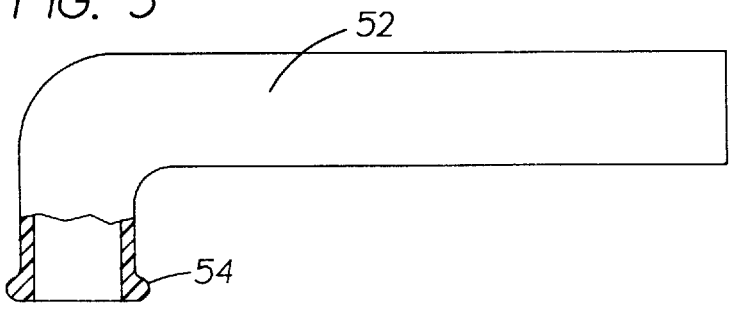
FIG. 3 is a side elevational view of the elbow.

An outwardly projecting key 60 (FIG. 2) extends vertically upwardly along the outside of the vertical tubular discharge portion 12 and is received by a vertical keyway 62 defined in the outer surface of the bell shaped portion. Extending outwardly from the connecting portion is a bracket 64 which includes a number of bores (not shown) which are aligned with corresponding bores 66 which are part of a second bracket 68 extending outwardly from the vertical tubular discharge portion. A connection pin 70 can be forcefully pushed through any two aligned bores to connect the parts together thereby enabling the top of the vertical discharge portion, wherever it has been cut to define a height of from 7½" to 11½", to be located above the water line.

What is claimed is:

1. A siphon for use with a flush type toilet having a tank with a drain hole at the bottom comprising a vertical tubular discharge portion including a vertical tube and means for securing the bottom of said vertical tubular discharge portion within the drain hole in the bottom of the tank, said vertical tube having a height selected so that it can be cut to define an installation height within a predetermined range of heights, a bell shaped inlet portion including a connecting portion having a downwardly extending tubular portion for telescopic insertion into said vertical tube, means for releasably connecting said vertical tubular discharge portion to said bell shaped portion including a bracket on said vertical tube having a plurality of vertically spaced horizontal pin receiving holes, a bracket on said connecting portion having a horizontal pin receiving hole and a connecting pin for insertion into aligned vertical tube and connecting portion pin receiving holes, whereby the relative vertical positions of said bell shaped portion and said vertical tube can be change to accommodate the vertical tube having a height within said range of heights.

2. A siphon for use with a flush type toilet having a tank with a drain hole at the bottom according to claim 1, further comprising a hole in said bell shaped inlet portion, an elbow secured within said bell shaped inlet portion hole, said elbow extending downwardly a selected distance to a bottom opening so that the elbow can be cut to define a flush height within said selected vertical range.

3. A siphon for use with a flush type toilet according to claim 2, wherein said releasably connecting means further includes a vertical key outwardly projecting from said vertical tubular discharge portion and a vertical keyway on said bell shaped portion for receiving said vertical key.

4. A siphon for use with a flush type toilet having a tank with a drain hole at the bottom comprising a vertical tubular discharge portion including a vertical tube and means for securing the bottom of said vertical tubular discharge portion within the drain hole in the bottom of the tank, said vertical tube having a height selected so that it can be cut to define an installation height within a predetermined range of heights, a bell shaped inlet portion including a connecting portion having a downwardly extending tubular portion for telescopic insertion into said vertical tube, means for releasably connecting said vertical tubular discharge portion to said bell shaped portion including a bracket on said vertical tube having vertically extending hole means, a bracket on said connecting portion having a hole and a connecting pin for insertion through said vertically extending hole means and through said connecting portion bracket hole, whereby the relative vertical positions of said bell shaped portion and said vertical tube can be change to accommodate the vertical tube having a height within said range of heights.

5. A siphon for use with a flush type toilet according to claim 4, wherein said vertically extending hole means comprises a plurality of vertically spaced holes.

* * * * *